US008397943B2

(12) United States Patent
Farid

(10) Patent No.: US 8,397,943 B2
(45) Date of Patent: Mar. 19, 2013

(54) APPARATUS FOR CONTAINING GOODS

(75) Inventor: Kamran Farid, Chesire, CT (US)

(73) Assignee: Edible Arrangements, LLC

( * ) Notice: Subject to any disclaimer, the term of this patent is extended or adjusted under 35 U.S.C. 154(b) by 146 days.

(21) Appl. No.: 12/775,069

(22) Filed: May 6, 2010

(65) Prior Publication Data

US 2011/0272424 A1 Nov. 10, 2011

(51) Int. Cl.
*B65D 81/00* (2006.01)

(52) U.S. Cl. ..... 220/759; 220/696; 220/752; 220/754; 220/755

(58) Field of Classification Search ..... 220/759, 220/776, 775, 773, 760, 619, 690, 490, 605, 220/676, 684, 685, 688, 696, 752, 756, 757, 220/754–755

See application file for complete search history.

(56) References Cited

U.S. PATENT DOCUMENTS

| | | | | | |
|---|---|---|---|---|---|
| 864,372 | A * | 8/1907 | Hoffmann et al. | ..... | 220/759 |
| 1,632,848 | A * | 6/1927 | Prahl | ..... | 220/760 |
| 1,648,281 | A * | 11/1927 | Polhamus | ..... | 220/760 |
| 2,329,656 | A * | 9/1943 | Sedgwick | ..... | 206/427 |
| 4,159,827 | A * | 7/1979 | Torrington | ..... | 414/416.01 |
| 2005/0133521 | A1 * | 6/2005 | Schwarz | ..... | 220/759 |

* cited by examiner

*Primary Examiner* — J. Gregory Pickett
*Assistant Examiner* — James M Van Buskirk
(74) *Attorney, Agent, or Firm* — Gerald R. Boss

(57) ABSTRACT

A container including a bottom support member, a vertical portion attached to the bottom support member and defining a containment space therein, and at least two handle receptacles positioned on an interior surface of the vertical portion. Each of the at least two handle receptacles includes an interior channel and an interlocking tab. The interior channel accepts an interlocking end of a selectively removable handle. The handle includes at least protrusion. The protrusion and the interlocking tab cooperate to selectively secure the handle to the container.

1 Claim, 4 Drawing Sheets

APPARATUS FOR CONTAINING GOODS

BACKGROUND

1. Field

The present disclosure relates to an apparatus for containing goods. More particularly, it relates to an apparatus for containing goods that includes a container and a selectively removable handle.

2. Description of Related Art

Containers having a removable handle are advantageous for many reasons. A removable handle allows a user to use a single handle on multiple containers that are either different or the same. Additionally, a container without a handle is often easier to store, stack and ship. Removal of a handle from a container eliminates wasted space in shipping and/or storage of the containers. Furthermore, removable handles are easier to store and/or ship when not attached to the container.

However, many containers with a removable handle do not provide the aesthetics offered by containers having permanent handles. While function is important in one use of the container and handle, aesthetics of the overall apparatus, i.e., the container and the handle, is important in many applications. Accordingly, there is a need for containers that have a removable handle that offer similar aesthetics and function of a container with a permanent handle.

SUMMARY

One aspect described herein is a container comprising: a bottom support member; a vertical portion attached to the bottom support member thereby defining a containment space therein; and at least two handle receptacles positioned on an interior surface of the cylindrical portion, each of the at least two handle receptacles having an interlocking tab configured to accept an interlocking end of a selectively removable handle.

Another aspect described herein is an apparatus for containing goods, the apparatus comprising: a container as described above; a removable handle having a first interlocking end and a second interlocking end; and at least one protrusion positioned on each of the first interlocking end and the second interlocking end of the removable handle, the first interlocking end of the removable handle is interlocked with one of the at least two handle receptacles and the second interlocking end of the removable handle is interlocked with one of the at least two handle receptacles.

These and other aspects are described in more detail below.

DETAILED DESCRIPTION

Figure 1:
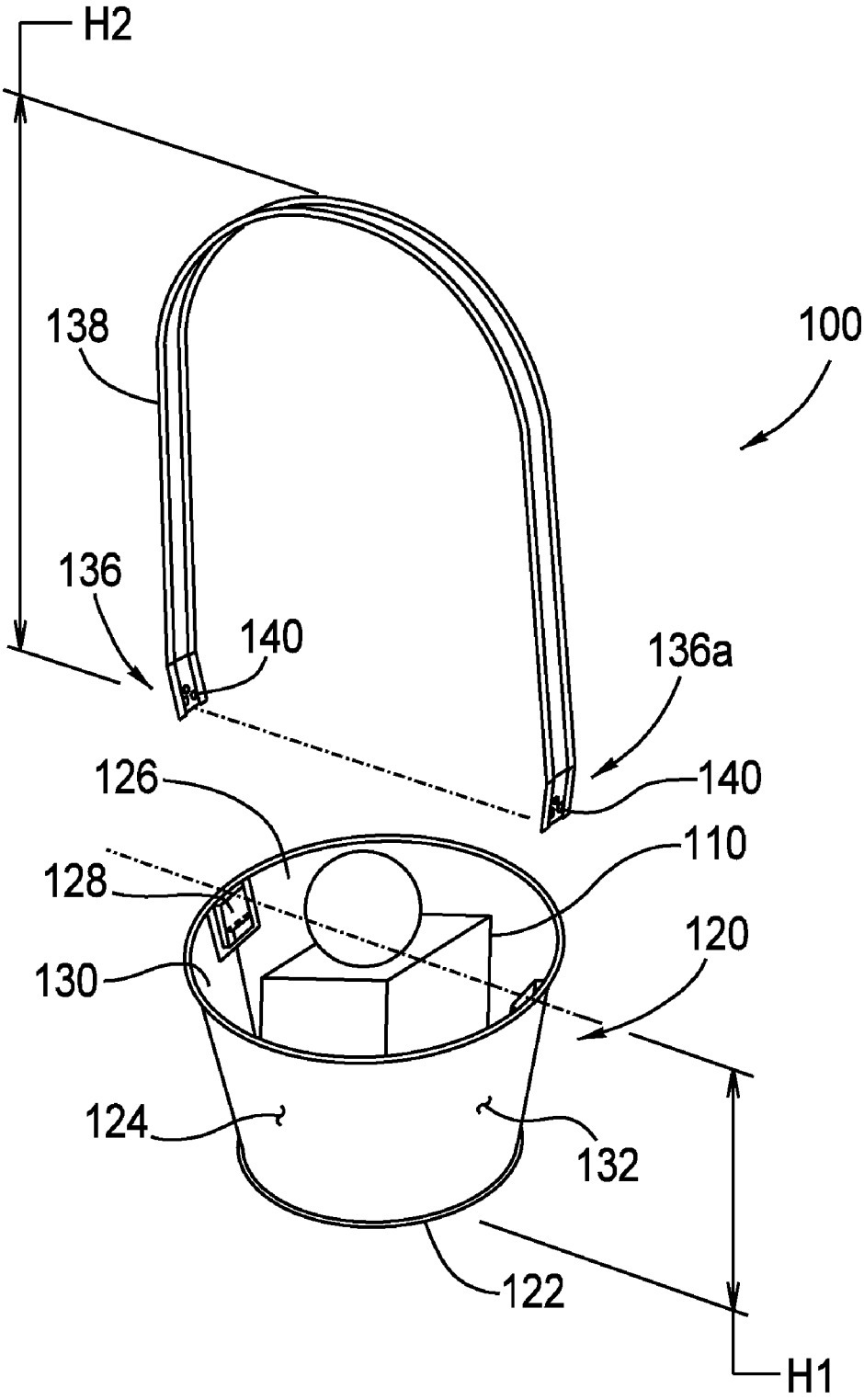
FIG. 1 is a perspective view of an apparatus according to one embodiment described herein.

FIG. 1 illustrates an apparatus 100 for containing goods 110, in accordance with one embodiment of this present invention. The goods 110 may include any item or items, such as, but not limited to, flowers, vegetable, fruit, food items such as tea, coffee, cookies, snacks, and the like, as well as gift items, such as soaps, lotions, gift cards, mugs, glasses, wine, and the like, as well as combinations thereof. The goods 110 may also include items such as, but not limited to, writing implements, office supplies, organizing items, tools, toys, baby supplies, cosmetics, and the like, as well as combinations thereof.

The apparatus 100 includes a container 120. The container 120 includes a bottom support member 122 and a vertical portion 124. One or both of the bottom support member 122 and the vertical portion 124 may be made of any material capable of containing the goods 110 such as, for example, aluminum, plastic and the like. In one embodiment, both the bottom support member 122 and the vertical portion 124 are made of the same material. In another embodiment, the bottom support member 122 and the vertical portion 124 are made of different materials.

The vertical portion 124 is coupled to and extends upwardly from the bottom support member 122 and defines a containment space 126. The goods 110 may be placed in the containment space 126. A volume of containment space 126 is defined by the size and shape of the bottom support member 122 and the vertical portion 124. In one embodiment, the vertical portion 124 and the bottom support member 122 are formed or molded as in integral structure.

The bottom support member 122 and the vertical portion 124 may any size and/or shape. In one embodiment, as shown in FIG. 1, the bottom support member 122 is circular in shape and the vertical portion 124 is cylindrical in shape. However, the apparatus 100 is not limited in this regard, as the bottom support member 122 and the vertical portion 124 of the container 120 may be in any shape desired by a user such as, for example, rectangular, triangular, or taper from a top portion of the vertical portion 124 to lower portion of the vertical portion 124, e.g., about a point of contact with the bottom support member 122.

The apparatus 100 also includes one or more handle receptacles 128. In one embodiment, as shown in FIG. 1, two handle receptacles 128 are shown positioned on an interior surface 130 of the vertical portion 124. However, it is contemplated that the handle receptacles 128 may be positioned on an exterior surface 132 of the vertical portion 124. Alternatively, one of the handle receptacles 128 may be positioned on the interior surface 130 while the second of the handle receptacles 128 may be positioned on the exterior surface 132. It should be appreciated that one or more handle receptacles may be employed to support various handle designs, as described below.

Figure 1A:
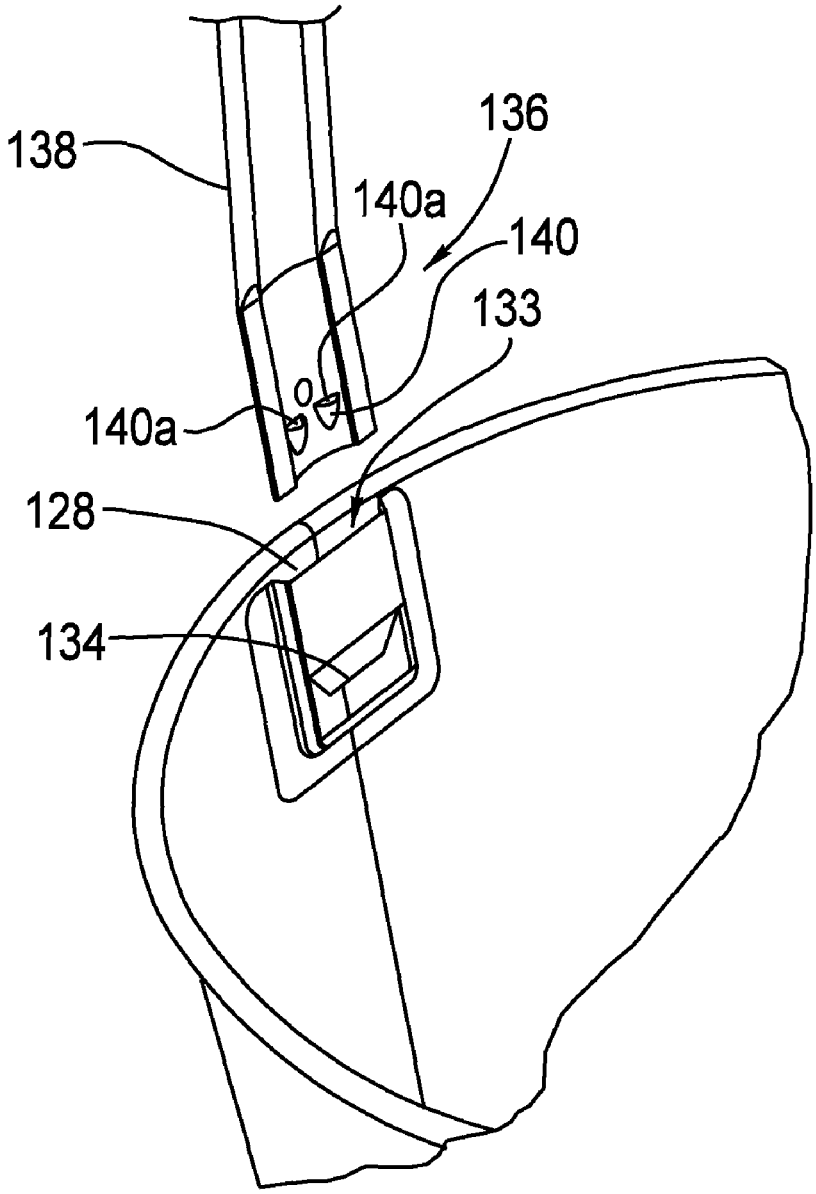
FIG. 1A is a perspective view of a portion of an apparatus according to one embodiment described herein.

As shown in FIG. 1A, which is an enlarged view of a portion of the apparatus 100, when coupled to the vertical portion 124, the handle receptacle 128 defines an interior slot or channel 133. The handle receptacle 128 includes an interlocking tab 134. The interlocking tab 134 is biased such that in a first or resting position, at least a portion 134*a* of the interlocking tab 134 extends into the interior channel 133. When a force is applied to the interlocking tab 134 in the direction away from the interior channel 133 (e.g., away from the vertical portion 124), the interlocking tab 134 defects out of the interior channel 133 leaving the interior channel 133 (or component passing therein) free from obstruction.

In accordance with one aspect of the present invention, the interior channel 133 and interlocking tab 134 are configured to accept an interlocking end 136 of a selectively removable handle 138. For example, the selective removable handle 138 is attached to the container 120 by inserting interlocking ends 136, 136*a* into the interior channel 133 of the handle receptacle 128. As best illustrated in FIG. 1A, at least one protrusion 140 is positioned on and extends from each of the interlocking ends 136 and 136*a* of the selectively removable handle 138. In one embodiment, the at least one protrusion 140 includes a seat or stop surface 140*a* that, as described below, cooperates with the interlocking tab 134 to inhibit withdrawal of the interlocking end 136 from the interior channel 133 once the protrusion 140 contacts the interlocking tab 134. In one embodiment, the stop surface 140*a* includes a recess that receives the portion 134*a* of the interlocking tab 134.

Figure 2:
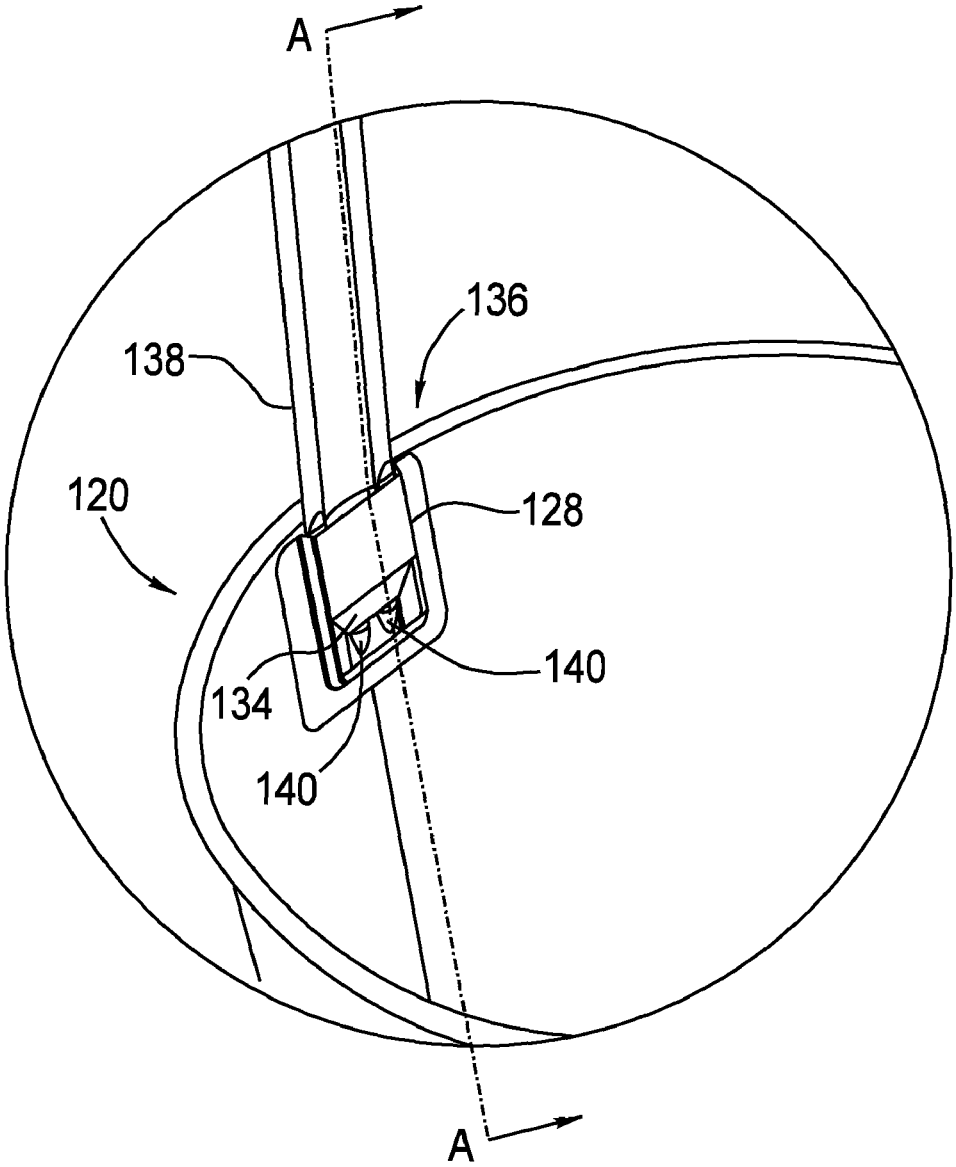
FIG. 2 is a perspective view of an apparatus according to one embodiment described herein.
Figure 2A:
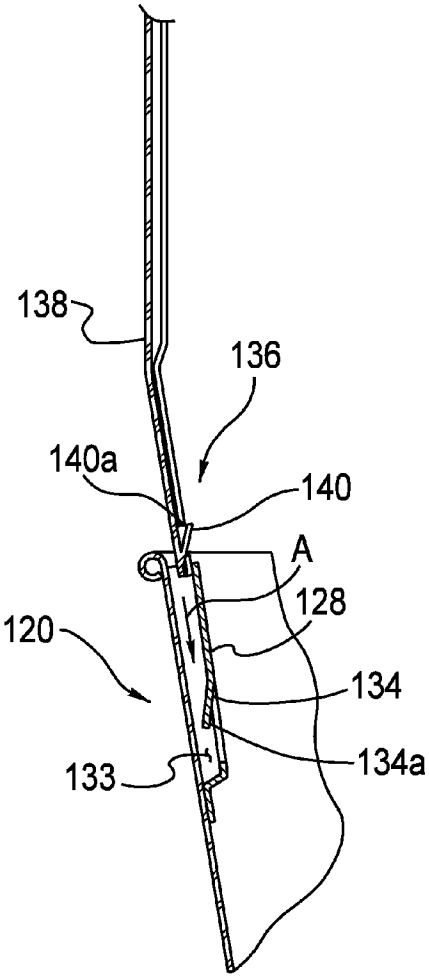
FIGS. 2A-2C is a perspective view of a portion of an apparatus according to one embodiment described herein taken along line A-A in FIG. 2.
Figure 2B:
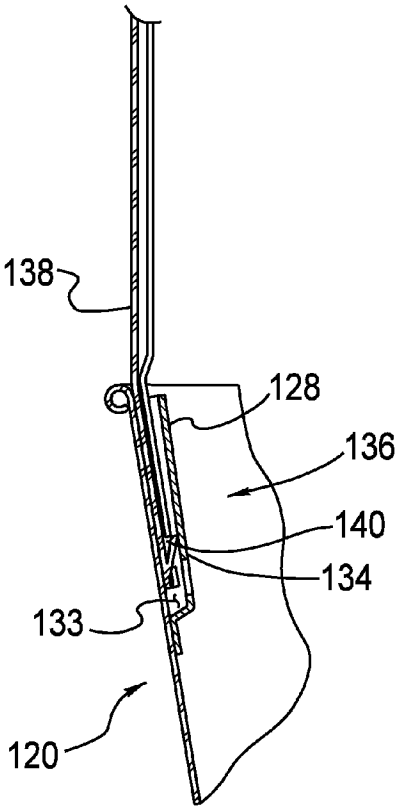
Figure 2C:
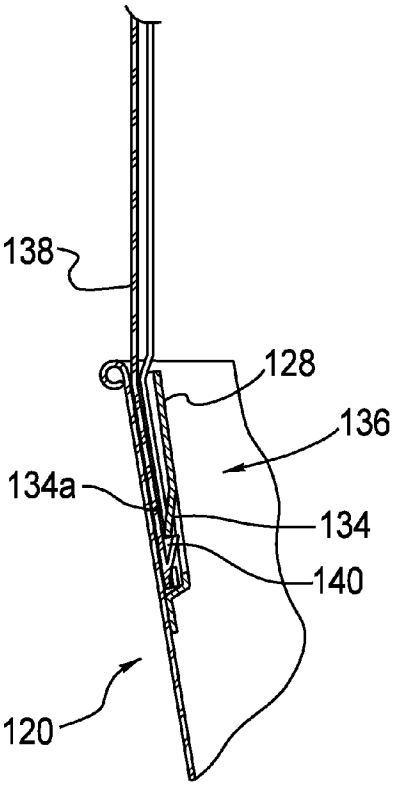

For example, as shown in FIGS. 2-2C, insertion of the interlocking end 126 into the interior channel 133 of the handle receptacles 128 (as illustrated by arrow A) causes the at least one protrusion 140 to deflect the interlocking tab 124 out of the interior channel 133 such that the interlocking end 136 slides under the interlocking tab 134, thereby connecting and locking the selectively removable handle 138 to the container 120 by a cooperating of the stop surface 140*a* and the interlocking tab 134. To remove the handle 148, the interlocking tab 134 is again deflected away from the interior surface 130 of the container 120 such that the protrusion 140 of the interlocking end 136 passes under the interlocking tab 134 and the interlocking end 136 and is withdrawn from the channel 133.

The protrusion 140 may be any shape of size. In one embodiment, the protrusion 140 is a rounded bump projecting outwards from a surface of the handle 138. The protrusion 140 may be attached to the handle 138, e.g., by welding, or may be integrated to the handle, e.g., be a part of the handle such as a tab punched and extending from the handle 138.

The selectively removable handle 138 and the protrusion 140 may be made of any material acceptable for use in the apparatus 100, including, but not limited to metal, ceramic, glass, and the like. The selectively removable handle 138 and protrusion 140 may be made of the same or different material than the container 120.

Referring again to FIG. 1, the container 120 is of a height $H_1$ and the handle 138 is of a height $H_2$. $H_1$ and $H_2$ may be a same or different height. When the handle 138 is secured to the container 120 the overall height of the apparatus 100 is $H_1+H_2$. Accordingly, the selectively removable handle 138 may be removed from the container 120 to reduce the overall height of the apparatus 100. For example, the selectively removable handle 138 may be removed from the container 120 to reduce a height if the apparatus 100 prior to shipping, for storage, or the like. Additionally, it is within the scope of the present invention to employ the selectively removeable handle 138 such that the container 120 may be used without the handle 138 for presentation of various goods 110. Moreover, it is within the scope of the present invention to employ the apparatus 100 with two or more interchangeable and selectively removeable handles 138. For example, in one embodiment, the interchangeable handle designs may include a one support arm handle, e.g., a handle with one interlocking end 136 attaching the handle to the container 120, a two support arm handle, e.g., the aforementioned handle 138 have two interlocking ends 136 and 136*a*, or a three or more support arm handle.

The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A container comprising:

a handle having a strap portion and a first and second interlocking end portion;

a bottom support member;

a vertical portion attached to the bottom support member having an interior surface and an exterior surface thereby defining a containment space therein;

a first handle receptacle disposed within said containment space of said vertical portion and a second handle receptacle disposed within said containment space of said vertical portion and disposed on an opposite side of said surface from said first handle receptacle;

said first handle receptacle having a rear surface and a front surface interconnected with and offset from said rear surface, said interconnection sections defining sides and a bottom, said rear surface, front surface and interconnection sections defining a channel and wherein said upper portions of said rear and front surfaces define an opening leading into said channel;

said first handle receptacle also including a flexible tab carried by said front section and biased for extending from a front profile defined by said front surface into said channel, said flexible tab offset from said bottom of said first handle receptacle defining a gap for receiving a portion of said handle;

said second handle receptacle having a rear surface and a front surface interconnected with and offset from said rear surface, said interconnection sections defining sides and a bottom, said rear surface, front surface and interconnection sections defining a channel and wherein said upper portions of said rear and front surfaces define an opening leading into said channel;

said second handle receptacle also including a flexible tab carried by said front section and biased for extending from a front profile defined by said front surface into said channel, said flexible tab offset from said bottom of said second handle receptacle defining a gap for receiving a portion of said handle;

said first interlocking end of said handle carrying a protrusion which extends beyond the profile of said strap, said protrusion having an upper surface for engaging said tab;

said second interlocking end of said handle carrying a protrusion which extends beyond the profile of said strap, said protrusion having an upper surface for engaging said tab; and wherein said first interlocking end is adapted to being received within said first handle receptacle in a manner wherein said protrusion deflects said biased tab out of said channel enabling said first interlocking end to extend past the lower portion of said tab to engage said bottom of said first handle receptacle and wherein said biased tab deflects back into said channel and engages said protrusions inhibiting said protrusions to move in an upper direction once past the lower profile of said tab; and wherein said second interlocking end is adapted to being received within said second handle receptacle in a manner wherein said protrusion deflects said biased tab out of said channel enabling said second interlocking end to extend past the lower portion of said tab to engage said bottom of said second handle receptacle and wherein said biased tab deflects back into said channel and engages said protrusions inhibiting said protrusions to move in an upper direction once past the lower profile of said tab.

* * * * *